United States Patent [19]

McDonald

[11] Patent Number: 5,004,953

[45] Date of Patent: Apr. 2, 1991

[54] EMERGENCY LIGHTING BALLAST FOR COMPACT FLUORESCENT LAMPS WITH INTEGRAL STARTERS

[75] Inventor: Charles W. McDonald, Memphis, Tenn.

[73] Assignee: The Bodine Company, Collierville, Tenn.

[21] Appl. No.: 374,451

[22] Filed: Jun. 30, 1989

[51] Int. Cl.[5] ..... H05B 37/00

[52] U.S. Cl. ..... 315/86; 315/171; 315/207; 315/DIG. 7; 315/360

[58] Field of Search ..... 315/86, 171, 172, 175, 315/225, 360, 207, DIG. 7

[56] References Cited

U.S. PATENT DOCUMENTS

| | | | |
|---|---|---|---|
| 3,688,123 | 8/1972 | Walker | 315/86 |
| 4,029,993 | 6/1977 | Alley | 315/86 |
| 4,587,460 | 5/1986 | Murayama | 315/86 |
| 4,803,406 | 2/1989 | Yasuda | 315/86 |
| 4,887,007 | 12/1989 | Almering | 315/175 |

FOREIGN PATENT DOCUMENTS

| | | | |
|---|---|---|---|
| 032761 | 7/1974 | United Kingdom | 315/256 |

*Primary Examiner*—Eugene R. Laroche
*Assistant Examiner*—Amir Zarabian
*Attorney, Agent, or Firm*—Spensley Horn Jubas & Lubitz

[57] ABSTRACT

A method and circuit for operating a fluorescent lamp having a starter with power supplied by a battery by generating an alternating current from energy supplied by the battery; supplying the alternating current as a starting current to the lamp for a selected period of time; and, at the end of the selected period of time, generating a direct current from the alternating current and supplying the direct current to the lamp in place of the alternating current.

11 Claims, 1 Drawing Sheet

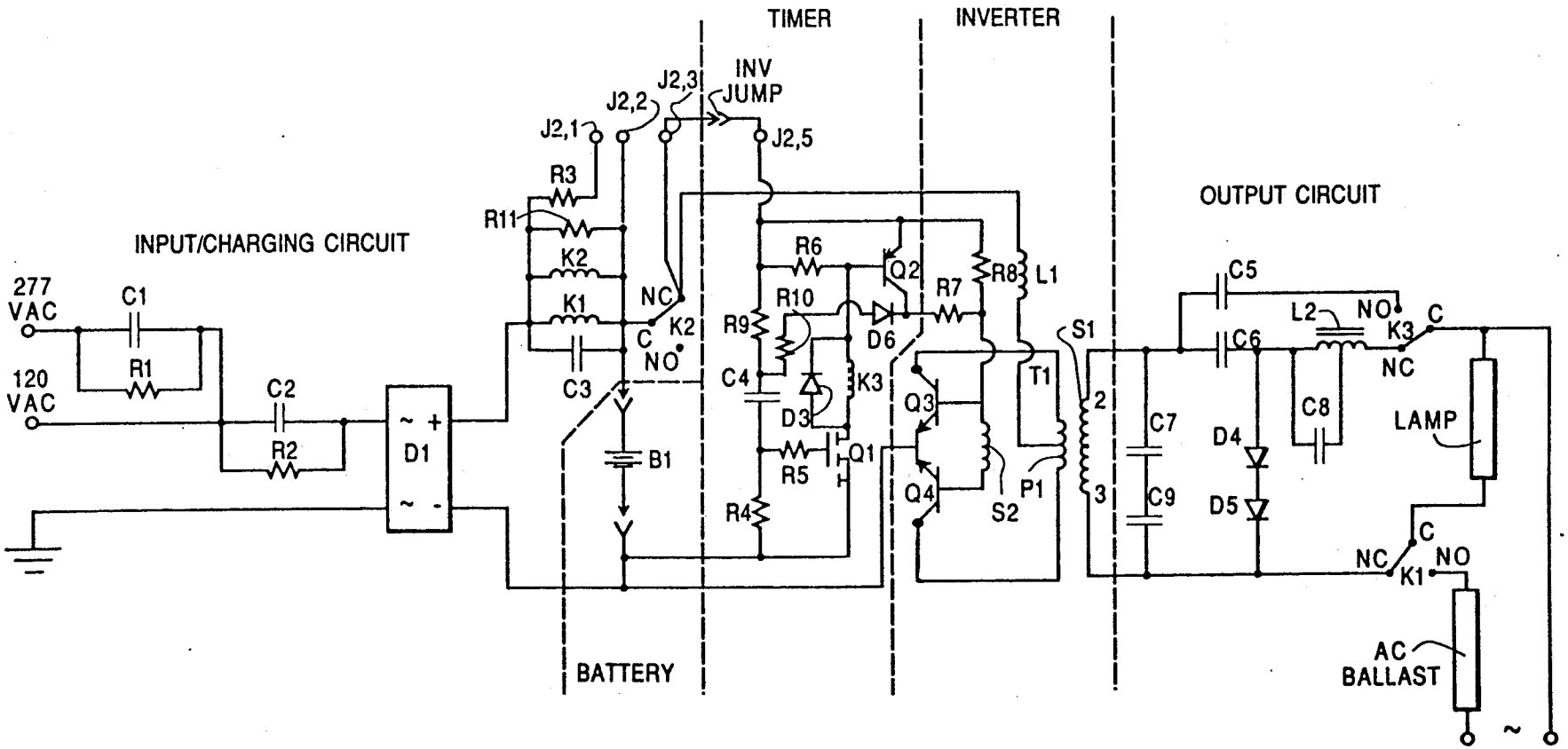
OUTPUT CIRCUIT
INVERTER
TIMER
BATTERY
INPUT/CHARGING CIRCUIT
LAMP
AC BALLAST
INV JUMP
277 VAC
120 VAC
C
NC
NO
K1
K2
K3
L1
L2
S1
S2
T1
P1
Q1
Q2
Q3
Q4
D1
D3
D4
D5
D6
B1
C1
C2
C3
C4
C5
C6
C7
C8
C9
R1
R2
R3
R4
R5
R6
R7
R8
R9
R10
R11
J2,1
J2,2
J2,3
J2,5

EMERGENCY LIGHTING BALLAST FOR COMPACT FLUORESCENT LAMPS WITH INTEGRAL STARTERS

BACKGROUND OF THE INVENTION

The present invention relates to power supplies for fluorescent lamps, and particularly for emergency operation of fluorescent lamps under battery power in the event of failure of a primary power supply.

While the provision of a battery back-up system for incandescent lamps is a relatively simple matter, emergency operation of fluorescent lamps under battery power poses certain difficulties, including those associated with the special starting requirements of fluorescent lamps.

It is known that a fluorescent lamp can be operated under battery power by supplying the lamp with a high frequency current derived from the battery by an inverter and supplied to the lamp via a ballast capacitor. A switching device is required to switch the circuit from a start mode to an operating mode. In the operating mode, the lamp continues to be supplied with alternating current and, because of the operating characteristics of fluorescent lamps, and particularly their negative resistance characteristic, the power supplied to the lamp during the operating mode cannot be reduced significantly, so that a fluorescent lamp could be operated for only a short period of time under battery power.

An alternative approach to battery powered operation is to convert the converter output into a full wave rectified current which is applied to the lamp. This would permit the lamp, after starting, to be operated at a reduced power level. However, it is difficult to start a fluorescent lamp with rectified current, particularly if the fluorescent lamp has an integral preheat starter.

SUMMARY OF THE INVENTION

It is a primary object of the present invention to enable a fluorescent lamp having an integral preheat starter to be operated for a prolonged period under battery power.

Another object of the invention is to provide the capability of operating a lamp at a reduced power level, after the lamp has been started, during operation under battery power.

The above and other objects are achieved, according to the present invention, by a method and circuit for operating a fluorescent lamp having a starter with power supplied by a battery by:

generating an alternating current from energy supplied by the battery;

supplying the alternating current as a starting current to the lamp for a selected period of time; and at the end of the selected period of time, generating a direct current from the alternating current and supplying the direct current to the lamp in place of the alternating current.

According to the invention, emergency operation is carried out by supplying a high amplitude, high frequency starting current to activate the lamp starter and, after a selected time period, automatically switching to a direct current which permits operation at a low power level while preventing the occurrence of voltage peaks which would re-ignite the lamp starter. To achieve this, the voltage supplying the direct current need only be filtered sufficiently to assure that its peak value is only slightly above its average value.

Lamps of the type employed in the practice of the present invention are provided with an integral starter circuit containing a gas discharge glow lamp which, during starting, generates heat to close a bimetallic switch to energize the filaments of the fluorescent lamp. If, subsequent to starting, the power applied to such a lamp should be reduced below a given value in a manner accompanied by a significant increase in peak voltage, the starter circuit could be reactuated, which would have the effect of turning the lamp off.

BRIEF DESCRIPTION OF THE DRAWING

The Figure is a circuit diagram of a preferred embodiment of a system for emergency operation of a fluorescent lamp.

DESCRIPTION OF THE PREFERRED EMBODIMENTS

The circuit shown in the Figure constitutes an emergency ballast for operating a fluorescent lamp, and particularly a fluorescent lamp having an integral starter circuit, from a battery in the event of failure of the main AC supply.

The system includes an input/charging circuit which provides charging current to battery B1 and disables the emergency operation mode as long as normal AC power is being supplied. The input/charging circuit has a first input terminal connectable to a source of high voltage, such as 277 VAC, and a second input terminal connectable to a source of a lower voltage, such as 120 VAC. Thus, the system can be selectively connected to either a high voltage source or a lower voltage source. A third input terminal is arranged to be connected to a ground referenced common conductor.

The two voltage terminals and the common terminal are connected to the AC inputs of a full wave rectifier D1, the higher voltage input terminal being connected via a series arrangement of a first RC circuit composed of a capacitor Cl and a resistor R1 and a second RC circuit composed of a capacitor C2 and a resistor R2. The lower voltage input terminal is connected to rectifier D1 only via the second RC circuit. The RC circuits serve to limit the charging current produced by rectifier D1.

The DC output from rectifier D1 is supplied to battery B1 via the coils of two relays K1 and K2, a capacitor C3 which filters the current supplied to the relay coils to prevent chattering, a resistor R3 connected in series with an LED charging status indicator, and a resistor R1 which limits the current through the relay coils in order to supply the desired charging current to battery B1 without overdriving the coils.

The input/charging circuit further includes a switch of relay K2 which connects a common terminal (C) to a normally open contact (NO) of relay K2 when its coil is energized and to a normally closed contact (NC) of relay K2 when its coil is de-energized, the latter position being that illustrated in the Figure. Relay K1 has a similar switch and associated set of contacts which are provided in the output circuit.

Battery B1 may be composed, for example, of four high temperature 1.2 V "D" nickel-cadmium cells connected in series. Alternate battery configurations are possible. The configuration described provides a nominal output of 4.8 volts at 4.0 Ampere-hours (Ah). If these batteries are employed to drive an inverter circuit which has a current consumption of 2.2 A, such a battery pack would provide more than 90 minutes of emergency operation. The charging current for battery B1 is preferably set at approximately 1/15 of the rated Ah capacity of the battery, so that the battery would be fully recharged within 24 hours.

The input charging circuit described thus far is connected to a timer which serves to place the inverter and output circuit in a high power mode for a selected period, which may be of the order of 5 to 10 seconds, after a power failure to permit starting of the fluorescent lamp.

The connection between the input/charging circuit and the timer may be effected via an inverter jumper, as shown. In the event of power failure, relays K1 and K2 are de-energized, so that battery B1 will be connected to the timer via the switch associated with relay K2.

The basic components of the timer include a capacitor C4, resistors R4 and R9, and a MOS-FET Q1. Resistors R4 and R9 and capacitor C4 are connected together in series across battery B1. The gate of transistor Q1 is connected to the junction between resistor R4 and capacitor C4 via a resistor R5 and the source-drain path of transistor Q1 is connected in series with the coil of a third relay K3 and a resistor R6, this series arrangement being connected in parallel with resistors R4 and R9 and capacitor C4. The source of transistor Q1 is connected to the negative terminal of battery B1.

A diode D3 is connected in parallel with the coil of relay K3. A bipolar transistor Q2 has its base connected to the junction between resistor R6 and the coil of relay K3, its emitter connected to the positive side of battery B1, and its collector connected via a diode D6 and a further resistor R10 to the connection point between resistor R9 and capacitor C4.

The inverter constitutes a self-resonant, switch mode power supply, also known as a push-pull converter, and includes a transformer T1 constructed to have an inductance setting gap in its core. Transformer T1 is composed of a tapped primary winding P1, a high voltage secondary winding S1 composed of a large number of turns of fine magnet wire, and a low voltage secondary winding S2. Two bipolar transistors Q3 and Q4 are connected so that the collector-emitter path of each is connected between a respective end of primary winding P1 and the negative terminal of battery B1, as shown. Low voltage secondary winding S2 is connected between the bases of transistors Q3 and Q4 to provide positive feedback from primary winding P1.

During emergency operation, the inverter is connected to battery B1 via an inductor L1 which is connected to a center tap of primary P1 to filter the supply current and provide instantaneous current limiting in the event that both transistors Q3 and Q4 are simultaneously rendered conductive during switching. A resistor R8 is connected between secondary winding S2 and battery B1 and a resistor R7 is connected between secondary winding S2 and diode D6 of the timer. The emitters of transistors Q3 and Q4 are connected to the negative terminal of battery B1.

The output circuit provides current limiting, and thus power regulation, for the lamp, and controls switching between normal lamp operation from the primary power supply and emergency operation, as well as switching, during emergency operation, between the high power starting mode and the low power operating mode.

The output circuit is composed of a series arrangement of two capacitors C7 and C9 across secondary winding S1. While a single high voltage capacitor could be employed, two lower rated capacitors are preferred because of their smaller overall physical size and lower cost. A first output capacitor C5 is connected between one side of secondary winding S1 and the normally open contact of the switch of relay K3. Capacitor C5 is connected to the lamp during emergency starting operation and acts as a ballast to limit the AC current to the lamp during starting.

The output circuit further includes an arrangement for supplying a filtered DC voltage to the lamp in the operating mode. This arrangement includes a capacitor C6 connected to one side of secondary winding S1 to serve as a ballast capacitor which limits the lamp current. Two diodes D4 and D5 forming a half wave voltage doubler are connected between the side of capacitor C6 which is remote from secondary winding S1 and the other side of secondary winding S1. A tapped inductor L2 is connected between capacitor C6 and the normally closed contact of the switch of relay K3. Inductor L2 provides smoothing of the half wave rectified current appearing downstream of diodes D4 and D5. A capacitor C8 is connected between one side of inductor L2 and the tap of that inductor and serves to delay the storage of energy in and the release of energy from inductor L2. During each half cycle when a current is supplied to inductor L2, energy is stored in both inductor L2 and capacitor C8. During the alternate half cycles, capacitor C8 and the section of inductor L2 connected in parallel therewith act as a parallel resonant circuit which provides a damped sine wave current at a frequency substantially higher than the inverter frequency. In this condition, inductor L2 acts as an auto transformer and couples energy from the resonant circuit portion of inductor L2 into the remaining portion of that inductor, which energy is then delivered to the lamp. It has been found that this circuit arrangement supplies to the lamp, during DC operation, a voltage which undergoes only small fluctuations.

During normal operation, when the main AC power supply is functioning, charging current is supplied from rectifier D1 to battery B1, while energizing relays K1 and K2 so that the timer, the inverter and the output circuit are inactive, and relay K3 is de-energized so that its common contact is connected to its normally closed contact. The common contact of each of relays K1 and K2 is connected to its normally open contact so that battery B1 is disconnected from the timer and the AC ballast is connected in series with the lamp.

If the main power supply should fail, relays K1 and K2 are de-energized so that the lamp is disconnected from the AC ballast and connected to the output circuit and battery B1 is connected across the inputs of the timer and inverter.

Upon initial application of battery voltage to the timer, voltage is applied to the gate of transistor Q1, rendering that transistor conductive. As a result, energizing current flows through the coil of relay K3 so that the common contact of the switch of relay K3 is connected to the normally open contact. In addition, when transistor Q1 is conductive, current flows through resistor R6 and the emitter-base path of transistor Q2 and transistor Q2 is driven into saturation, resulting in a current flow through resistor R7 of the inverter. Resistor R7 is given a sufficiently low resistance to supply a base current which will drive transistors Q3 and Q4 in the high power emergency starting mode.

The current supplied by battery B1 charges capacitor C4 and when the voltage across capacitor C4 reaches a value such that transistor Q1 can no longer remain in saturation, the current through the coil of relay K3 begins to decrease and eventually reaches the point at which relay K3 is deactivated. At this point, the switch of relay K3 is operated to place the output circuit in the emergency operating mode, in which the lamp is supplied with direct current at a reduced power level.

Transistor Q2 is given a sufficient gain to produce a base current which will cause transistor Q2 to remain in saturation even after the current through transistor Q1 has dropped to the point at which relay K3 is de-energized. This insures that sufficient drive current will be provided to the inverter until after the output circuit has completely switched to the low power DC operating mode.

During the start mode, the voltage across battery B1 drops slightly and is modulated by the high level starting current flowing through the conductors, the internal battery resistance, and other circuit impedances. As the charge on capacitor C4 approaches the point at which switching will occur from the start mode to the operating mode, the current through transistor Q1, the coil of relay K3 and the base-emitter path of transistor Q2 will assume a pulsating DC form due to the modulated signal on the power supply conductor. This will cause the potential at the collector of transistor Q2 to pulse in the negative direction and when it has become sufficiently negative to forward bias diode D6, the voltage at the positive terminal of capacitor C4 will drop, associated with a current flow through resistors R9 and RIO, to cause transistor Q1 to turnoff more rapidly, thereby accelerating relay switching. This feature effectively counteracts the tendency of the relay switching to be slowed by the rise in the battery voltage as the current demand on the battery decreases from the start mode level to the operating mode level.

Diode D3 also enhances relay turnoff by allowing current to flow as a result of the back EMF generated by the collapse of the magnetic field in the coil of relay K3, allowing that field to decay at a higher rate.

Transistor Q2 turns off shortly after transistor Q1 and resistor R6 shunts any leakage current which might tend to cause transistor Q2 to be partially conductive. After capacitor C4 has been fully charged and both transistors Q1 and Q2 have switched off, there is virtually no further current flow through the timer.

Resistor R5 and the gate-to-source protection diode which is an integral part of transistor Q1 provide the discharge path for capacitor C4 when normal operating power is restored to the system. The discharge time of capacitor C4 is short enough that if power is restored only momentarily, the timer will nevertheless be able to reinitiate another emergency start cycle, thus insuring continued provision for emergency lighting as long as battery B1 remains sufficiently charged.

During the emergency starting mode, energizing current is supplied to primary winding Pl of transformer T1 via inductor L1, causing the inverter to begin oscillating. Positive feedback is provided at secondary winding S2 and bias current for operating transistors Q3 and Q4 is supplied via resistors R7 and R8 when the circuit is in the emergency start mode and only via resistor R8 when the system is in the emergency DC operating mode. Inductor L1, in addition to providing a filtered current supply to transformer T1, provides instantaneous current limiting in the event that both transistors Q3 and Q4 are conductive simultaneously during switching. A high frequency, high voltage output is generated across secondary winding S1.

Because of the additional bias current applied via resistor R7 during the starting mode, the inverter is able is produce a higher output power in the starting mode than in the operating mode. The frequency of the output supplied by the inverter is determined by the capacitance and inductance of transformer T1, including the inductance associated with the gap in the transformer core, and by the load capacitance and inductance.

The reduction in bias current in the operating mode can reduce the battery bias current drain by the order of 10%, thereby prolonging emergency operation of the lamp. Moreover, reduction of the bias current results in reduced heat dissipation in the inverter so that components having a lower wattage rating, and thus a lower cost, can be used in the inverter.

An exemplary embodiment of the circuit according to the invention was employed to operate an Osram Dulux D (TM) 26 watt quad compact fluorescent lamp, with inverter operating at a nominal frequency of 29 KHz and capacitor C5 having a value of 6800 pF. During the initial phase of an emergency start operation, the starting arc voltage across the starter was about 500 VRMS at a low current level. The lamp filaments are heated and the bimetal switch in the starter closes briefly and then opens and the lamp is turned on. During the remainder of the start mode, the voltage across the lamp has a value of the order of 55 VRMS and the lamp draws a current of 350–360 mA, resulting in a power consumption of about 20 W.

Upon switching to the DC operating mode, the components for supplying the DC voltage are selected so that the voltage across the lamp has an average value of 150 V and the lamp draws a current of the order of 50 mA, the lamp thus operating with a power consumption of only 7.5 W.

Because the peak amplitude of the filtered DC voltage is only slightly higher than its average value, a relatively high voltage can be provided without any danger of re-igniting the starting circuit.

Embodiments of the invention could employ a full wave rectifier in place of half wave rectifier D4, D5. This would require additional contacts in relay K3 to connect both ends of the rectifier output.

In the output circuit, capacitors C7 and C9 provide a load across secondary winding S1 even if no lamp is connected to the circuit. In the emergency start mode, high frequency alternating current is supplied to the lamp via capacitor C5. At the end of the starting period, the contacts of relay K3 are switched so that a filtered DC current is produced by diodes D4 and D5 and supplied to the lamp via inductor L2 and capacitor C8.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method for operating a fluorescent lamp having a starter with power supplied by a battery comprising:

generating an alternating current from energy supplied by the battery;

supplying the alternating current as a starting current to the lamp for a selected period of time; and at the end of the selected period of time, generating a direct current from the alternating current by effecting half-wave rectification of the alternating current, and supplying the direct current to the lamp in place of the alternating current.

2. A method as defined in claim 1 further comprising, at the end of the selected period of time, reducing the pere level of the alternating current.

3. A method as defined in claim 1 wherein said step of generating a direct current further comprises smoothing the current resulting from the half-wave rectification.

4. A method as defined in claim 1 wherein said step of generating alternating current is performed by an inverter connected to received an operating current and a bias current from the battery, and further comprising, at the end of the selected period of time, reducing the level of the bias current supplied by the battery to the inverter.

5. A circuit for operating a fluorescent lamp having a starter with power supplied by a battery comprising:

means for generating an alternating current from energy supplied by the battery;

means connected for supplying the alternating current as a starting current to the lamp for a selected period of time; and means including a half-wave rectifier connected for generating, at the end of the selected period of time, a direct current from the alternating current and supplying the direct current to the lamp in place of the alternating current.

6. A circuit as defined in claim 5 wherein said means for supplying the alternating current comprise: a timer having an input connected to receive an input voltage for producing an output signal for a selected period of time after the start of reception of the input voltage; and first switch means connected to be controlled by the timer output signal for connecting the lamp directly to said means for generating an alternating current while the output signal is being produced and for connecting the lamp to said means for generating a direct current upon disappearance of the output signal.

7. A circuit as defined in claim 6 wherein said means for generating an alternating current comprise an inverter having an output.

8. A circuit as defined in claim 7 wherein said inverter is connected to received a bias current from the battery, and said timer comprises means connected to said inverter for reducing the level of bias current supplied to said inverter after disappearance of the output signal.

9. A circuit as defined in claim 5 wherein said means for generating a direct current signal further comprise: an inductance connected for conducting the direct current to the lamp.

10. A circuit as defined in claim 9 wherein said means for generating a direct current further comprise a capacitance connected in parallel with a portion of said inductance.

11. A circuit as defined in claim 5 wherein said means for generating a direct current further comprise smoothing means for smoothing the current from said rectifier.

* * * * *